United States Patent [19]

Pearson

[11] Patent Number: 4,458,387

[45] Date of Patent: Jul. 10, 1984

[54] UPHOLSTERY PANEL NAIL CONSTRUCTION

[75] Inventor: Kenneth C. Pearson, Glenview, Ill.

[73] Assignee: Hartco Company, Skokie, Ill.

[21] Appl. No.: 372,096

[22] Filed: Apr. 26, 1982

[51] Int. Cl.[3] ..... A44B 1/18; A44B 9/00

[52] U.S. Cl. ..... 24/101 B; 24/152; 297/218; 411/442; 411/457; 411/461; 256/DIG. 3

[58] Field of Search ..... 24/90 B, 93–96, 24/101 B, 152, 153 R; 52/712; 256/DIG. 3; 297/218; 411/442, 457, 458, 459, 461, 470, 487

[56] References Cited

U.S. PATENT DOCUMENTS

| | | | |
|---|---|---|---|
| 140,430 | 7/1873 | Ogborn | 256/DIG. 3 |
| 251,616 | 12/1881 | McGill | 256/DIG. 3 |
| 447,634 | 3/1891 | Ogborn | 24/153 R |
| 1,125,115 | 1/1915 | Kell | 24/153 R |
| 1,593,408 | 7/1926 | Honigbaum | 411/461 |
| 1,645,120 | 10/1927 | Sterbenz | 297/218 |
| 1,755,538 | 4/1930 | Draughon, Jr. | 411/457 |
| 2,586,388 | 2/1952 | Schafroth | 411/442 |
| 3,099,058 | 7/1963 | Pettingell | 297/218 |
| 3,703,304 | 11/1972 | Losee | 52/712 |
| 3,741,068 | 6/1973 | Andruskiewicz | 411/461 |

*Primary Examiner*—Gene Mancene
*Assistant Examiner*—James Hakomaki
*Attorney, Agent, or Firm*—Wallenstein, Wagner, Hattis, Strampel & Aubel

[57] ABSTRACT

A panel nail construction adapted to be assembled on a backing material used in making shaped, upholstered panels employed in the making of furniture, and the like. The panel nail construction is provided with backing material-retaining means which enable it to be attached on a backing material. The panel nail construction advantageously is used in the form of a strip comprised of panel nails integrally, but separably, interconnected along the adjacent transverse margins of the head portion of each of the panel nails. In this form, the panel nail construction can be rapidly, and selectively, assembled on a backing material with an automatic machine or tool.

14 Claims, 16 Drawing Figures

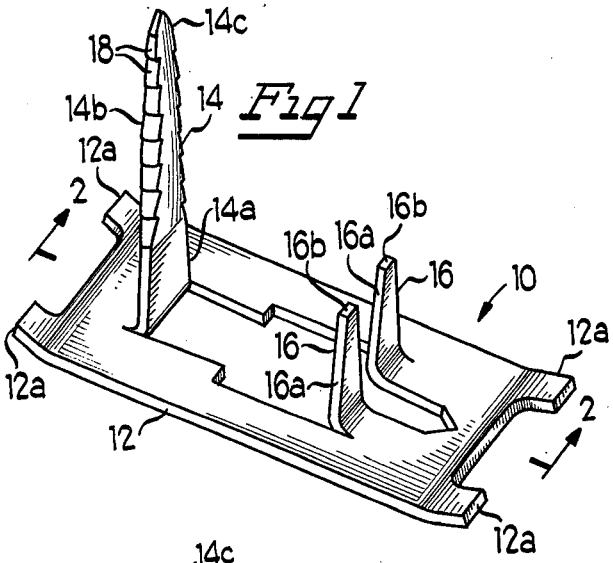
Fig 1
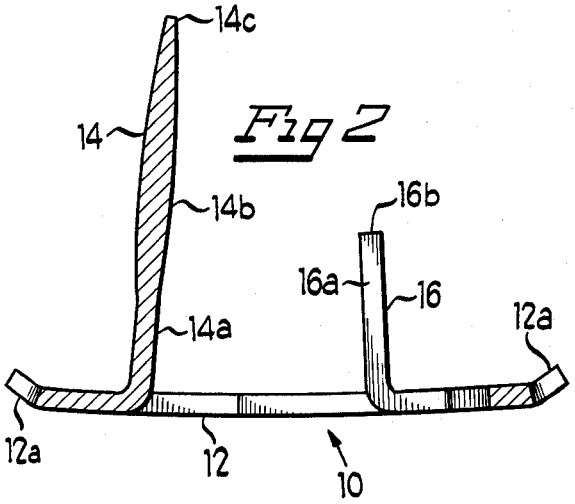
Fig 2
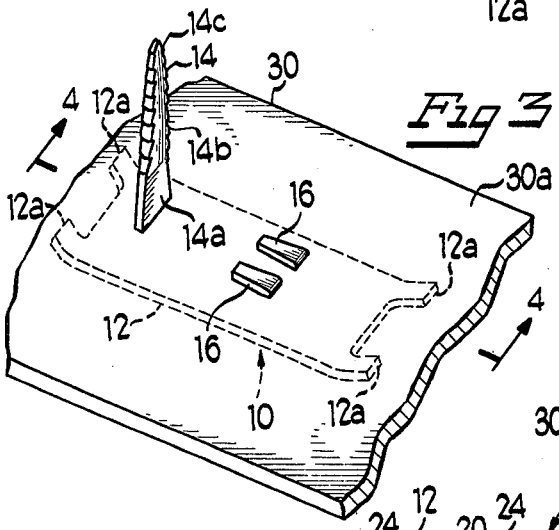
Fig 3
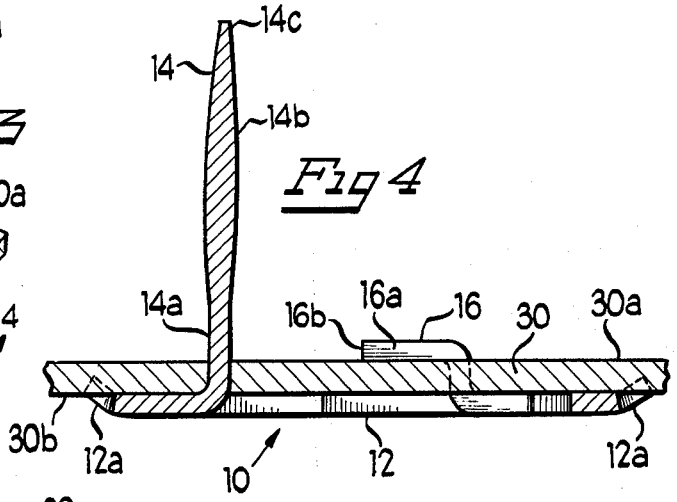
Fig 4
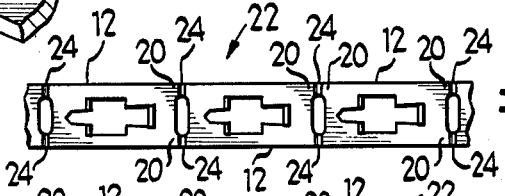
Fig 5
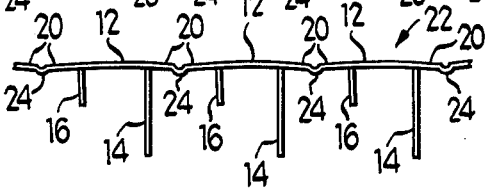
Fig 6
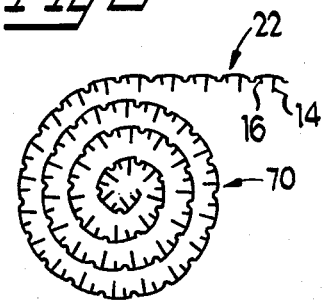
Fig 8
Fig 16
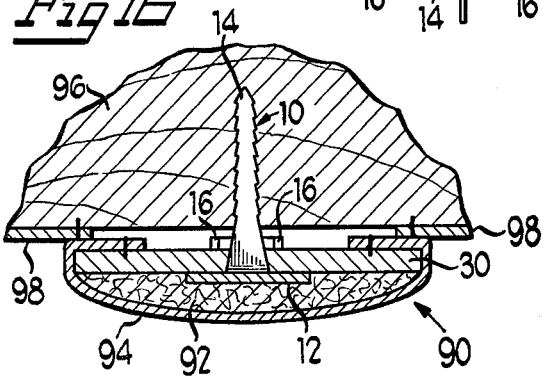

Fig 7
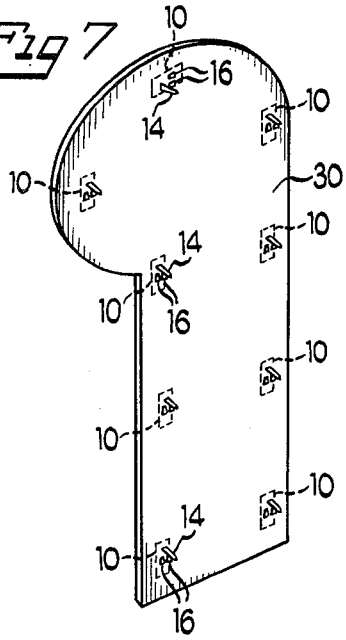
Fig 9
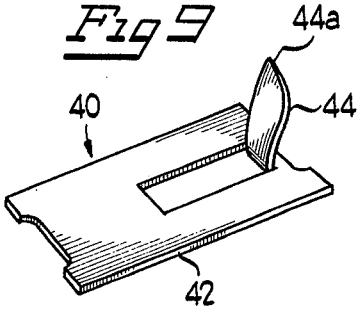
Fig 10
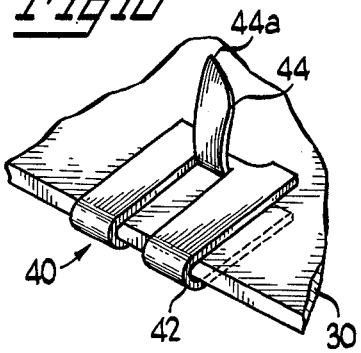
Fig 11
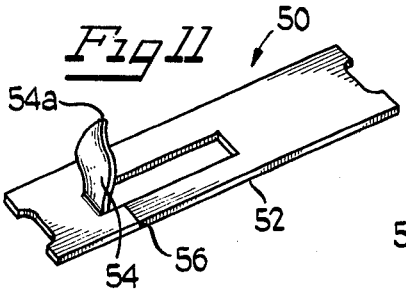
Fig 12
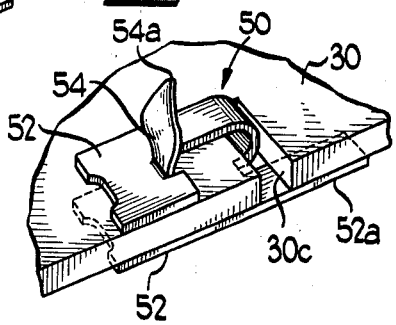
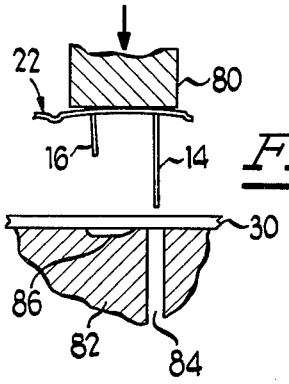
Fig 15
Fig 14
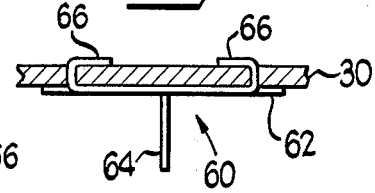
Fig 13
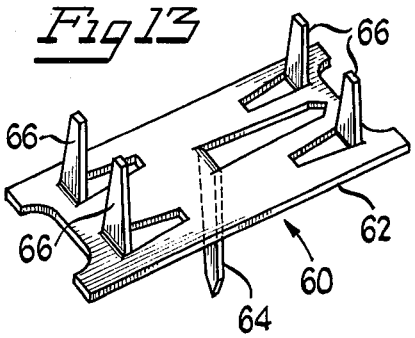

UPHOLSTERY PANEL NAIL CONSTRUCTION

TECHNICAL FIELD

The present invention relates to a panel nail, especially to a strip of separably interconnected panel nails, for use in securing shaped, upholstered panels to furniture.

BACKGROUND OF PRIOR ART

In the manufacture of upholstered chairs, love seats, or sofas, it is often desirable or necessary to apply finished upholstered panels to the front of arms, on the outer sides of the arms, or even to complete backs of the piece of furniture. If the fabric is leather, these panels are usually assembled to the furniture with decorative, brass-headed tracks. When the upholstered fabric is a tufted or an open weave material as a tweed the panels are attached to the furniture by hand or power driven brads which are driven through the heavy fabric and are therefore invisible after the panel is attached to the furniture. However, if the furniture and the panels are upholstered with a fine material such as a satin, velvet or chintz material, decorative tacks look out of place and brads would ruin the fabric. In these instances, it has been common practice to improvise with large-headed tacks, roofing nails or tacking strips attached to the panel backing material in various ways, none of which are very satisfactory. These panels are then upholstered on one side with the fine fabric, and the nails, their heads covered in some manner, protruding from the other side. The panels are then attached to the furniture by means of a soft-headed or rubber mallet by hammering with care against the fabric until the nails are seated. During this operation, it is hoped the heads of the tack or nail will stay attached to the panel back material so the final fabric is neat and smooth and the nails completely hidden.

BRIEF SUMMARY OF THE INVENTION

In accordance with the present invention, a panel nail construction has been evolved which eliminates the problems and shortcomings of fastening means heretofore used to attached finished upholstered panels on furniture. The unique, one-piece construction of the panel nail makes it especially adaptable for manufacture and use in the form of an elongated panel nail strip comprising a plurality of panel nails integrally, but separably, interconnected. In this form, the panel nails can be attached to the panel backing material by a machine into which the panel nail strip is fed. In such an operation, the individual panel nails of the strip can be rapidly and positively attached to a panel backing material at any selected position on the material in a minimum of time and with a minimum of labor. The nail head of the panel nail construction is especially designed to be invisible and to remain hidden when the finished upholstered panel is attached to an article of furniture.

The panel nail construction, in brief, comprises a generally rectangularly shaped head portion having a nail shank integrally joined to and extending at substantially a right angle from one side thereof. The head portion also is provided with backing material-retaining means integrally joined thereto, and adapted to be bent or crimp into engagement with a backing material thereby to rigidly secure the panel nail on the backing material. In one form of the panel nail construction, the backing material-retaining means comprises a pair of spaced prongs, or pin-like extensions extending at substantially a right angle from the same side of the nail head on which the nail shank is positioned. The prongs or pin-like extensions are characterized in that they are shorter in length than the nail shank, and have a cross-sectional area such that they can be readily bent or crimp into engagement with the backing material when the panel nail is attached thereto. In another of its forms, the prongs, or pin-like extensions of the panel nail are positioned on the side of the nail head opposite to that on which the nail shank is located. In this form of invention, two pairs or prongs, or pin-like extensions advantageously are provided, each of the pairs desirably being located adjacent to the ends of the nail head. In yet another embodiment of the panel nail construction, the head portion itself comprises the backing material-retaining means. In this form, the nail head is bent or wrapped into engagement with the backing material along the margins thereof, or at a preselected location away from the margins of the backing material. As indicated hereinabove, the panel nail construction is especially suited for manufacture and use in the form of a strip comprising a plurality of nails. In this form, the nail head portion of each of the panel nails is integrally, but separably, interconnected along the length of the strip by integral interconnecting extensions or webs at the adjacent transverse margins of the nail heads. The extensions or webs advantageously are scored or swaged to facilitate separation of the panel nails from the strip by an automatic machine or tool. While the interconnecting extensions or webs act to maintain the nail head portions in aligned relation to one another, they have sufficient flexibility to enable the strip to be rolled into a comparatively compact coil. The nail head portion of the panel nail construction desirably is somewhat convex in shape so that when the reciprocatable blade or plunger of an automatic tool engages the nail head it will flex slightly inwardly causing the severed portions of the interconnecting extensions or webs along the transverse margins of the nail heads to be at least partly embedded in the backing material to which the panel nail is attached.

The foregoing, and other features and advantages of the panel nail construction of this invention will become more apparent from the description to follow, taken in conjunction with the accompanying drawings.

BRIEF DESCRIPTION OF THE DRAWINGS

FIG. 1 is an enlarged view in perspective of an embodiment of the panel nail construction of the present invention;

FIG. 2 is a sectional view of said embodiment taken substantially along line 2—2 of FIG. 1;

FIG. 3 is a fragmentary view in perspective showing said embodiment of the invention attached to a backing material;

FIG. 4 is an enlarged sectional view taken substantially along line 4—4 of FIG. 3;

FIG. 5 is a top plan view showing a portion of a panel nail strip formed of a plurality of panel nails as illustrated in FIG. 1;

FIG. 6 is a side view in elevation of the panel nail strip illustrated in FIG. 5;

FIG. 7 is a view in perspective of a representative shaped backing material with a number of the panel nails of this invention attached thereto;

FIG. 8 is a somewhat schematic side view in elevation of a coil formed of a panel nail strip such as is shown in FIGS. 5 and 6;

FIG. 9 is an enlarged view in perspective of another embodiment of the panel nail construction of the present invention;

FIG. 10 is an enlarged view in perspective showing the panel nail of FIG. 9 attached to a backing material;

FIG. 11 is an enlarged view in perspective of yet another embodiment of the panel nail construction of the present invention;

FIG. 12 is an enlarged view in perspective showing the panel nail of FIG. 11 attached to a backing material;

FIG. 13 is an enlarged view in perspective of still another embodiment of the panel nail construction of this invention;

FIG. 14 is an enlarged side view, partly in section, showing the panel nail of FIG. 13 attached to a backing material;

FIG. 15 is a fragmentary side elevational view, partly in section, showing a panel nail being attached to a backing material by an automatic machine or tool; and FIG. 16 is a fragmentary sectional view showing a finished upholstered panel, with panel nails of the present invention attached to the upholstered backing material, after the finished panel has been hammered into position on the wooden framework of an article of furniture.

DETAILED DESCRIPTION OF THE INVENTION

Referring, now, in particular, to FIGS. 1 and 2 of the drawings, the embodiment of the panel nail construction there shown, and designated generally by reference numeral 10, comprises a rectangularly shaped nail head portion 12 having struck therefrom, and extending outwardly at substantially a right angle from one side thereof, an elongated nail shank 14, and a pair of shortened backing material-retaining prongs or pins 16—16. The nail shank 14, as illustrated, comprises a base portion 14*a* integrally joined to an intermediate or central portion 14*b*, the central portion 14*b*, in turn, being integrally joined to a tip or outer end portion 14*c*. The converging side margins of the central portion 14*b*, and the end portion 14*c*, desirably are provided with a plurality of teeth or serrations 18 which act to lock the shank 14 in the wooden framework of an article of furniture when the finished upholstered panel is hammered into position.

The base portion 14*a*, at its juncture with the nail head portion 12 is curved slightly outwardly for added strength. The base portion 14*a* comprises the widest area of the nail shank 14, and serves to resist any torsional forces which may be applied to a finished, upholstered panel when the shank 14 is embedded in the wooden framework of an article of furniture. The central portion 14*b* of the shank 14 advantageously is thickened as by swaging to rigidify and strengthen the shank 14. The bellied configuration thusly impressed upon the central portion 14*b* acts, in cooperation with the teeth or serrations 18, to firmly lock the shank 14 in place. The teeth or serrations 18 desirably are formed in the side margins of the central and outer end portions of the shank 14 at the same time that the central portion 14*b* is swaged, or otherwise thickened.

The backing material-retaining prongs or pins 16—16, as shown in FIGS. 1 and 2, are positioned in spaced, substantially parallel relation to each other. Each of the pins 16—16 is shorter than the nail shank 14, and each is provided with gently tapered side margins 16*a*—16*a* which terminate in a blunt tip 16*b*.

The nail head portion 12 of the embodiment of the panel nail construction 10 desirably has a slightly convex configuration as best shown in FIG. 2. The transverse margins of the nail head portion 12 each has a pair of projections or arms 12*a*—12*a* which extend slightly inwardly in the direction of the nail shank 14 and the pins 16—16. In accordance with a preferred embodiment of the invention, the arms 12*a*—12*a* comprise portions of webs 20—20 which interconnect the adjacent transverse margins of the nail head portions 12 of the panel nail construction 10 when it is fabricated in the form of a panel nail strip 22 as shown in FIGS 5 and 6. The interconnecting portions or webs 20—20 advantageously are reduced in thickness by scoring, or, preferably, by swaging, as indicated at 24 in FIGS. 5 and 6, to facilitate separation of the panel nails from the strip 22 by an automatic machine or tool as they are assembled on a backing material.

Referring, now, to FIGS. 3 and 4 of the drawings, the embodiment of the panel nail construction illustrated in FIGS. 1 and 2 is shown attached to a backing material 30. The material 30 may comprise any of various materials, including cardboard, paperboard, chipboard, plywood, or the like, utilized to make upholstered panels used in the manufacture of furniture. When a force is applied to the nail head portion 12 by a machine or tool, the nail shank 14 and the pins 16—16 easily penetrate and pass through the backing material. The pins 16—16 are simultaneously crimped or bent into overlying engagement with the inner side 30*a* of the backing material 30 by the machine or tool employed to attach or assemble the panel nail to the backing material. The nail shank 14 remains in its normal, outwardly extending condition ready to be hammered into the wooden framework of a piece of furniture after the panel material, with the panel nails attached thereto, has been upholstered. The force applied to the nail head portion by the machine or tool acts to partly embed the arms 12*a*—12*a* on the transverse margins of the nail head portion 12 into the backing material as best shown in FIG. 4. The design of the nail head portion is such that it presents a smooth, fixed surface which will not be disturbed when the finished upholstered panel is hammered into position on the framework of an article of furniture, and which, equally importantly, will not be visible or make any impression in the fabric used to upholster the panel.

Referring, now, to FIGS. 9 and 10 of the drawings, the embodiment of the panel nail construction there shown, and designated generally by reference numeral 40, comprises a nail head portion 42 having a nail shank 44 struck therefrom and extending outwardly at substantially a right angle from one side thereof. The nail shank 44 is turned or twisted slightly along its longitudinal axis, and is provided with a pointed end 44*a*. As best shown in FIG. 10, the nail head portion 42, itself, functions as the backing material-retaining means in that it is bent, wrapped, or clamped on a pre-shaped backing material 30.

The embodiment of the panel nail construction illustrated in FIGS. 11 and 12, and designated generally by reference numeral 50, is similar to the panel nail construction 40 shown in FIGS. 9 and 10 in that it comprises a nail head portion 52 having a single nail shank 54 struck therefrom. The nail shank 54, like the nail shank 44, is twisted slightly along its longitudinal axis, and is provided with a relatively sharp pointed end 54*a*. The nail head portion 52, as in the case of the portion 42 of the panel nail 40, acts as the backing material-retaining means of the panel nail 50. However, the nail head portion 52 is slit as at 56 to provide a backing material engaging arm 52*a* which is positioned on the side of the backing material 30 opposite to that on which the nail shank 54 is located when the head portion is bent, wrapped, or clamped onto the material 30. The facilitate attachment of the panel nail 50 to the backing material, slots, such as slot 30*c*, can be formed at selected points along the margins of the backing material, or a combination of slots and openings (not shown) can be provided in the body of the backing material for receiving the panel nail.

The embodiment of the panel nail construction shown in FIGS. 13 and 14, and designated generally by reference numeral 60, comprises a nail head portion 62 having a nail shank 64 struck therefrom and extending outwardly at substantially a right angle from one side thereof. Integral with, and extending outwardly from the opposite side of the nail head portion 62 are two pairs of backing material-retaining prongs or pins 66—66. The nail shank 64 is similar to the nail shank 14 of the panel nail 10 shown in FIGS. 1 and 2 in that it comprises integral base, central and end portions. The central portion is thickened as by swaging to rigidify and strengthen the shank 64, and teeth or serrations are provided along the converging margins of the shank 64. As shown in FIG. 14, the panel nail 60 is attached to a backing material 30 by either forcing the backing material onto the pins 66—66 and bending or crimping them into engagement with the backing material, or by applying a force to the panel nail 60 sufficient to enable the pins 66—66 to penetrate the backing material and crimping the pins into engagement with the backing material.

It should be understood that each of the embodiments 40, 50 and 60 of the panel nail construction can be manufactured and used in the form of a strip similar to the strip 22 illustrated in FIGS. 5 and 6. The strips can be formed into a coil 70 as schematically shown in FIG. 8. Such a coil may comprise several hundred panel nails, and can be positioned in a container adjacent to an automatic machine or tool for sequentially, and selectively, assembling the panel nails on a backing material. The entire operation can be carried out in a minimum of time with minimal labor, and provides an end product which is superior to that produced by prior, manual methods for attaching fastening means such as nails and tacks to a backing material.

In FIG. 15 of the drawings there is schematically illustrated a machine or tool of a type which may be used for assembling the panel nails of this invention on a backing material. The machine or tool has a reciprocatable blade or plunger 80 adapted to sequentially sever panel nails, such as the panel nails 10, from a strip 22 which may be in the form of a coil. The severed nail is attached in a single high-speed operation of the backing material 30 supported on an anvil or die 82 having a slot 84 for receiving the nail shank 14 and a forming recess 86 for bending or crimping the pins 16—16 into engagement with the backing material. In FIG. 7 of the drawings, the backing material 30, configured for use, after upholstering, as a trim piece for the arm of an article of furniture, for example, is shown with the panel nails 10 asembled thereon at preselected, strategic locations.

In FIG. 16 of the drawings, a finished, upholstered panel 90, fabricated from the backing material 30 to which panel nails 10 of the present invention have been attached, is illustrated. The finished panel 90, as shown, comprises the backing material 30, a plurality of panel nails, such as the panel nail 10, a cushioning or padding material 92 which may be formed of foam, or cotton, and a finishing layer 94 comprising fabric, plastic, leather, or the like. The panel 90 is secured on an article of furniture by hammering the nail shanks 14 extending outwardly from one side of the finished upholstered panel 90 into the wooden framework 96 of the article of furniture. The framework 96 is usually covered with a fabric 98, for example, which is the same as the finishing layer 94 on the upholstered panel 90.

While for purposes of illustration, preferred embodiments of this invention have been disclosed, other embodiments thereof may become apparent to those skilled in the art and, accordingly, this invention is to be limited only by the scope of the appended claims.

What is claimed is:

1. A unitary, one-piece panel nail adapted to be assembled to a backing material used in making shaped, upholstered panels of the type employed in the fabrication of furniture, and the like, having a wooden framework, comprising: a head portion, a nail shank struck from the head portion and extending at substantially a right angle from one side of the head portion, said nail shank having a length and thickness such that it can be hammered into and penetrate the wooden framework of an article of furniture, or the like, and thereafter maintain an upholstered panel to which the panel nail has been assembled thereon, and backing material-retaining means formed from the head portion and being adapted to be bent into engagement with a backing material thereby to secure the panel nail on the backing material with the nail shank being oriented thereon in a manner to enable it to be hammered into and penetrate the wooden framework of an article of furniture, or the like.

2. A panel nail according to claim 1 wherein the backing material-retaining means comprises at least one pin-like projection struck from the head portion and having a length less than the length of the nail shank and a cross-sectional area such that it can be readily bent into engagement with a backing material to which the panel nail has been attached.

3. A panel nail according to claim 1 wherein the backing material-retaining means comprises a pair of pin-like members struck from the head portion and positioned in spaced apart, substantially parallel relation to one another.

4. A panel nail according to claim 1 wherein the nail shank comprises a widened base portion, a thickened central portion and a tapered end portion, the widened base portion acting to resist any torsional forces placed on an upholstered panel which has been secured by means of the panel nail to the frame of an article of furniture, or the like, and the thickened central portion acting to rigidify and strengthen the nail shank.

5. A panel nail according to claim 1 wherein the head portion of the panel nail has a convex configuration thereby to cause the end margins of the head portion to be at least partly embedded in the backing material when the panel nail is assembled on the backing material.

6. A panel nail according to claim 1 wherein the backing material-retaining means is positioned on the same side of the head portion as the nail shank.

7. A panel nail according to claim 1 wherein the backing material-retaining means is positioned on the side of the head portion opposite to the side on which the nail shank is positioned.

8. A panel nail according to claim 1 wherein the backing material-retaining means comprises a section of the head portion, said section being adapted to act in cooperation with the remainder of the head portion to secure the panel nail on a backing material.

9. A panel nail strip for use in a tool for assembling panel nails on a backing material employed in making shaped, upholstered panels of the type used in the manufacture of furniture, and the like, having a wooden framework, comprising an integral, elongated metal strip of panel nails including a plurality of nail heads integrally, but separably, interconnected along the length of the metal strip by integral interconnecting portions at the adjacent transverse margins of the nail heads, each of the panel nails of the strip including a nail shank struck from the nail heads and extending at substantially a right angle from one side of the nail heads, said nail shank having a length and thickness such that it can be hammered into and penetrate the wooden framework of an article of furniture, or the like, and thereafter maintain an upholstered panel to which its associated panel nail has been assembled thereon, each of the panel nails further including backing material-retaining means formed from the nail heads and being adapted to be bent into engagement with a backing material to which the panel nails of the strip are assembled thereby to secure each panel nail on the backing material with the nail shank of each panel nail being oriented thereon in a manner to enable it to be hammered into and penetrate the wooden framework of an article of furniture, or the like.

10. A panel nail strip according to claim 9 wherein the backing material-retaining means comprises at least one prong struck from its associated nail head and having a length less than the length of its associated nail shank and a cross-sectional area such that it can be readily bent into engagement with the backing material.

11. A panel nail strip according to claim 9 wherein the backing material-retaining means comprises at least one pair of prongs struck from its associated nail head and positioned in spaced apart, substantially parallel relation to one another.

12. A panel nail strip according to claim 9 wherein each of the nail heads has a convex configuration.

13. A panel nail strip according to claim 9 wherein the integral interconnecting portions comprise extensions of reduced width and thickness at the adjacent transverse margins of the nails heads.

14. A panel nail strip according to claim 9 wherein the panel nail strip is rolled into a coil for storage and/or use in a tool for assembling the panel nails comprising the strip on a backing material.

* * * * *